US012635759B2

(12) United States Patent
Medioni

(10) Patent No.: US 12,635,759 B2
(45) Date of Patent: May 26, 2026

(54) PLANTAR ORTHOSIS

(71) Applicant: Delphine Medioni, Sucy en Brie (FR)

(72) Inventor: Delphine Medioni, Sucy en Brie (FR)

( * ) Notice: Subject to any disclaimer, the term of this patent is extended or adjusted under 35 U.S.C. 154(b) by 277 days.

(21) Appl. No.: 17/627,382

(22) PCT Filed: Jul. 9, 2020

(86) PCT No.: PCT/EP2020/069351
§ 371 (c)(1),
(2) Date: Jan. 14, 2022

(87) PCT Pub. No.: WO2021/008987
PCT Pub. Date: Jan. 21, 2021

(65) Prior Publication Data

US 2022/0256966 A1 Aug. 18, 2022

(30) Foreign Application Priority Data

Jul. 17, 2019 (FR) ..... 1908040

(51) Int. Cl.

| | |
|---|---|
| ***A43B 7/14*** | (2022.01) |
| ***A43B 7/142*** | (2022.01) |
| ***A43B 7/1425*** | (2022.01) |
| ***A43B 7/144*** | (2022.01) |
| ***A43B 7/149*** | (2022.01) |
| ***A43B 7/24*** | (2006.01) |
| ***A43B 17/02*** | (2006.01) |

(52) U.S. Cl.
CPC ..... *A43B 7/142* (2013.01); *A43B 7/1425* (2013.01); *A43B 7/144* (2013.01); *A43B 7/149* (2013.01); *A43B 7/24* (2013.01); *A43B 17/023* (2013.01)

(58) Field of Classification Search
CPC ..... A43B 7/142; A43B 7/1425; A43B 7/144; A43B 7/1463; A43B 7/1464; A43B 7/1469; A43B 7/149; A43B 7/16; A43B 7/24; A43B 17/023
See application file for complete search history.

(56) References Cited

U.S. PATENT DOCUMENTS 2,421,088 A * 5/1947 Sims ..... A43B 17/00 36/174
2,616,190 A * 11/1952 Darby ..... A43B 7/1425 36/144
3,084,695 A * 4/1963 O'Donnell ..... A43B 7/1445 36/174
4,704,809 A * 11/1987 Ballard ..... A43B 5/001 36/134

(Continued)

FOREIGN PATENT DOCUMENTS

FR 3007253 A1 * 12/2014 ..... A43B 3/108

OTHER PUBLICATIONS

International Search Report as issued in International Patent Application No. PCT/EP2020/069351, dated Oct. 26, 2020.

*Primary Examiner* — Sharon M Prange
(74) *Attorney, Agent, or Firm* — CUSHMAN PARTNERS LLC

(57) ABSTRACT

A plantar orthosis has a first sole and a plurality of raised corrective elements, the plantar orthosis including a first corrective element formed by a heel ring; a second corrective element formed by a rear pronation element; and a third corrective element formed by an internal half-couple.

14 Claims, 5 Drawing Sheets

(56) References Cited

U.S. PATENT DOCUMENTS

| | | | | |
|---|---|---|---|---|
| 4,841,648 | A * | 6/1989 | Shaffer | A43D 999/00 36/43 |
| 5,138,774 | A | 8/1992 | Sarkozi | |
| 5,976,100 | A * | 11/1999 | Greenawalt | A43B 7/142 36/43 |
| 6,510,626 | B1 * | 1/2003 | Greenawalt | A43B 7/142 36/43 |
| 7,426,794 | B2 * | 9/2008 | Swensen | A43B 13/181 36/43 |
| 7,757,321 | B2 * | 7/2010 | Calvert | A43B 7/1464 5/652 |
| 9,788,602 | B2 * | 10/2017 | Wynn | A43B 7/143 |
| 11,622,601 | B2 * | 4/2023 | Piacentini | A43B 7/144 36/25 R |
| 2006/0059726 | A1 * | 3/2006 | Song | A43B 7/1464 36/144 |
| 2006/0277796 | A1 * | 12/2006 | Gallegos | A43B 17/02 36/44 |
| 2008/0060229 | A1 * | 3/2008 | Epstein | A43B 7/16 36/43 |
| 2009/0049712 | A1 | 2/2009 | Steszyn et al. | |
| 2011/0072685 | A1 | 3/2011 | Gutowsky et al. | |
| 2012/0233881 | A1 * | 9/2012 | Orien | A43B 7/149 36/44 |
| 2017/0006961 | A1 * | 1/2017 | Pedersen | A43B 17/023 |
| 2018/0192739 | A1 * | 7/2018 | Granger | A43B 17/14 |
| 2020/0107612 | A1 * | 4/2020 | Schickling | A43B 7/149 |

* cited by examiner

[Fig 2]
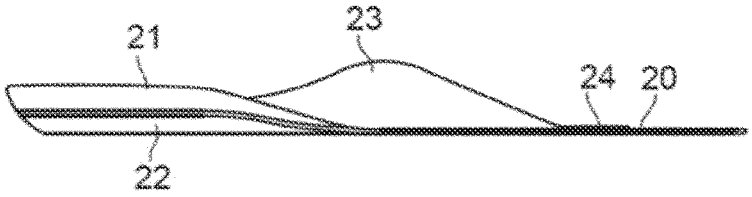
[Fig 3]
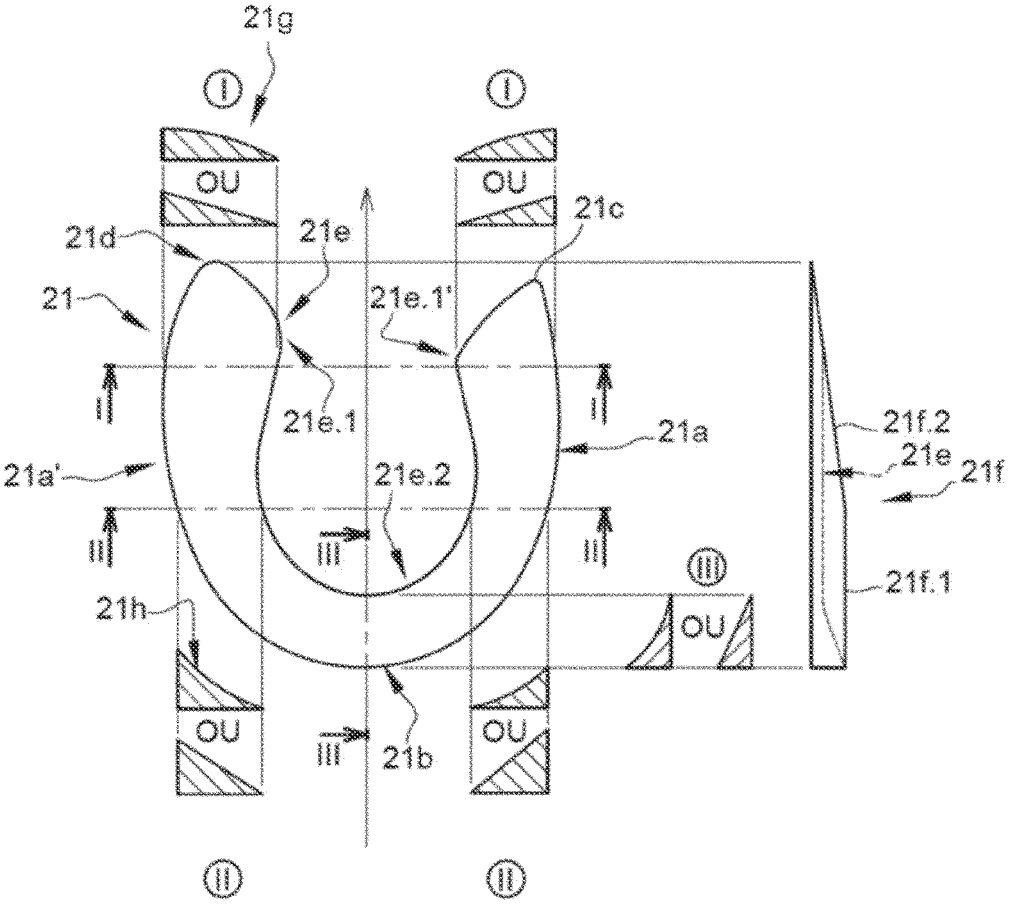

[Fig 4]
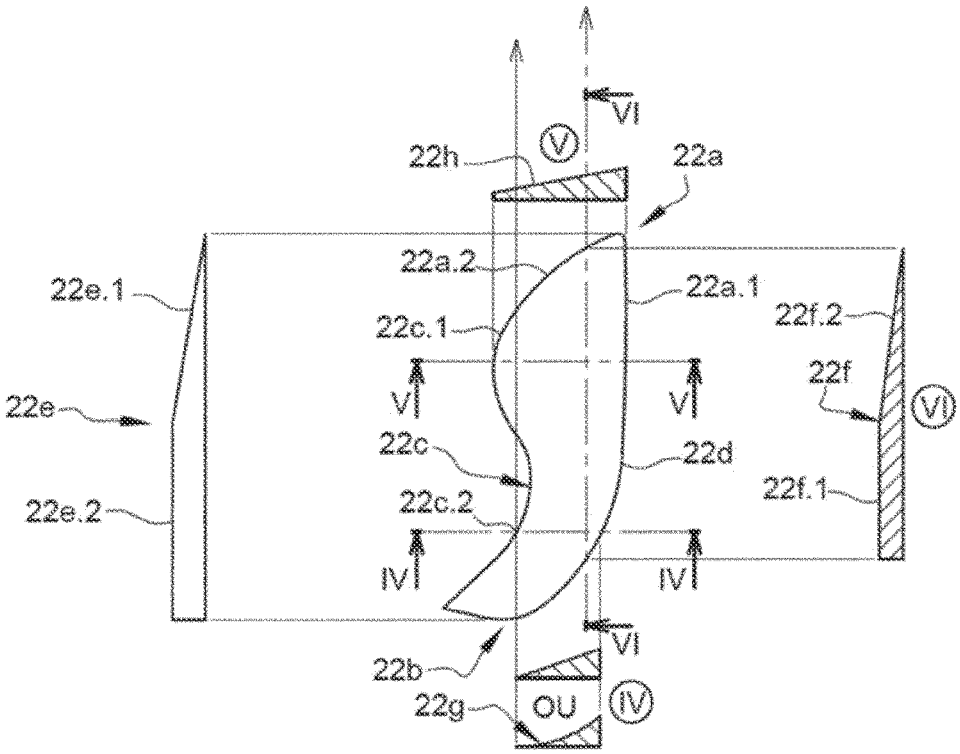

[Fig 5]
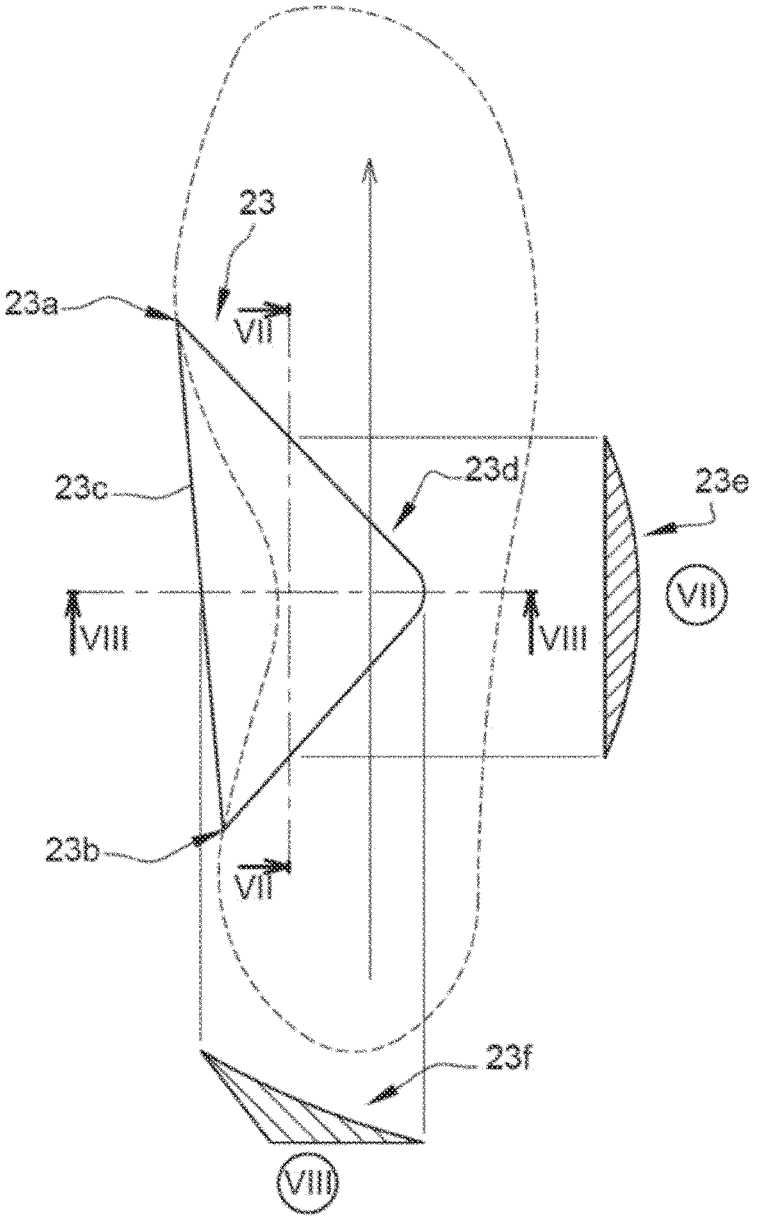

[Fig 6]
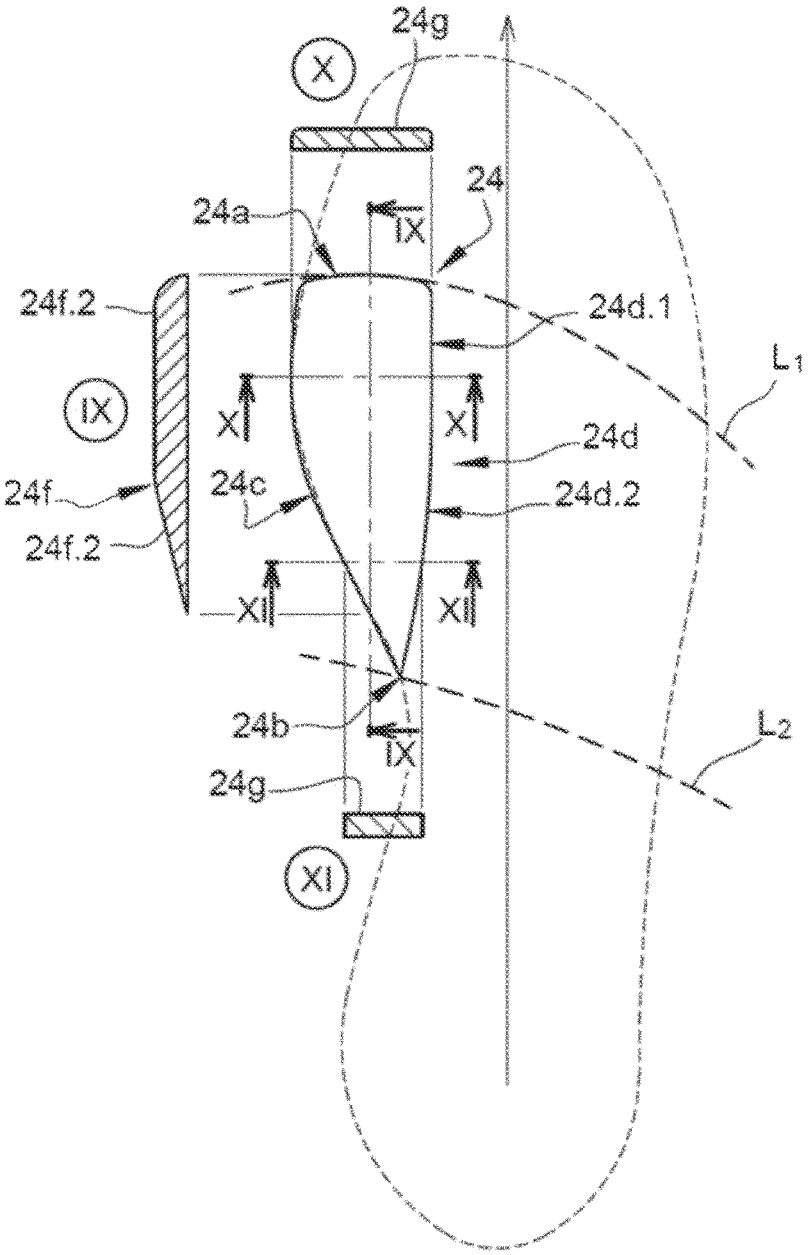

PLANTAR ORTHOSIS

CROSS-REFERENCE TO RELATED APPLICATIONS

This application is the U.S. National Stage of PCT/EP2020/069351, filed Jul. 9, 2020, which in turn claims priority to French patent application number 1908040 filed Jul. 17, 2019. The content of these applications are incorporated herein by reference in their entirety.

TECHNICAL FIELD OF THE INVENTION

The field of the invention is that of plantar orthoses, or orthopaedic soles.

PRIOR ART

It is known to manufacture customised plantar orthoses of which the geometry is chosen to ensure a corrective action at the level of certain zones of the foot as a function of the necessities of the person intended to wear the orthoses.

Already known in the prior art are a multitude of plantar orthoses for satisfying a certain number of demands for orthopaedic soles for a certain number of pathologies encountered.

Also known are universal plantar orthoses comprising several corrective elements which make it possible to treat a large number of pathologies.

However, for certain pathologies, practitioners have to resort directly to more complicated surgical operations, because there does not exist today other treatment means making it possible to relieve the pain of the patient. This is the case notably when the patient is suffering from internal femorotibial osteoarthritis at the level of the internal knee compartment.

When the patient is suffering from femorotibial osteoarthritis, he feels permanent discomfort, a mechanical type of pain while walking, difficulty going up and down stairs, and even a pain which irradiates the upper part of the affected leg and the lower part of the thigh.

If no action is taken to treat these symptoms, creaking, blockages and sensations of buckling of the knee become more and more important until reaching radiological stage 4 where surgical operation becomes necessary.

Today, no solution exists making it possible to delay degeneration into stage 4. The only solutions provided by the medical profession are solutions for improving the comfort of the patient and decreasing pain, such as infiltrations, anti-pain medication, or the application of a cold source.

The applicant has noted that in the event of an internal femorotibial osteoarthritic impairment, one obtains in general, at the radiological level, a genu varum, i.e. a deviation of the lower limb in the frontal plane, leading to a compression of the internal knee compartment, and thus a reduction of the space of the internal knee compartment. This hyper pressure at the level of the internal knee compartment is thus a factor favouring the onset of osteoarthritis because the hyper pressure at the level of this internal compartment leads to premature wear of the cartilage.

DESCRIPTION OF THE INVENTION

In this context, the invention proposes a novel plantar orthosis having a particular profile making it possible to reduce or even to delay pain due to an osteoarthritic impairment at the level of the internal knee compartment, by changing in an unexpected manner the spatial configuration under the foot while respecting the physiology of the foot and the joint mobilities.

To this end, the invention relates to a plantar orthosis comprising a first sole and a plurality of raised corrective elements, said plantar orthosis being characterised in that it comprises:

- a first corrective element formed by a heel ring;
- a second corrective element formed by a rear pronation element;
- a third corrective element formed by an internal half-couple.

Advantageously, the plantar orthosis according to the invention comprises an advantageous combination of corrective elements making it possible to modify the tibia/femur axis while respecting the physiology of the foot and the joint mobilities. Thus, thanks to the plantar orthosis according to the invention, it is possible to delay the premature wear of the cartilage at the level of the internal knee compartment, and thus surgical intervention. In this situation, surgical intervention may no longer be an obligatory act and may be avoided.

The plantar orthosis according to the invention may also have one or more of the characteristics below, considered individually or according to all technically possible combinations thereof:

- the plantar orthosis comprises a fourth corrective element formed by a sub-antero-capital support element of the first ray; said first corrective element and/or said second corrective element and/or said third corrective element and/or said fourth corrective element
- is formed from a material from the following list: ethylene-vinyl acetate (EVA) foam, polyethylene (PE) foam, polyurethane (PU) foam, polyolefin (PO) foam, latex foam, cork;
- said first corrective element comprises a maximum height comprised between 5 mm and 8 mm, and preferentially a height of 6 mm;
- said second corrective element comprises a maximum height comprised between 3 mm and 7 mm, and preferentially a height of 6 mm;
- said third corrective element comprises a maximum height of 20 mm;
- said fourth corrective element comprises a maximum height comprised between 1 mm and 3 mm;
- said first corrective element, and/or said second corrective element, and/or the fourth corrective element has a hardness comprised between 50 Shore A and 70 Shore A;
- said third corrective element has a hardness comprised between 20 Shore A and 40 Shore A;
- said plantar orthosis comprises a damping element positioned above said first corrective element;
- said third corrective element formed by an internal half-couple is positioned above said first corrective element such that said third corrective element covers at least partially said first corrective element
- said second corrective element formed by a rear pronation element is positioned on said first sole or under the first sole.

The subject matter of the invention is also a method for manufacturing a plantar orthosis according to the invention.

Advantageously, the plantar orthosis is made by gluing said corrective elements on said first sole.

Advantageously, the plantar orthosis is made by a conventional technique by elements, by thermoforming, by use of a 3D printer, by use of a 3D milling machine.

The subject matter of the invention is also a shoe comprising a plantar orthosis according to the invention.

Advantageously, the plantar orthosis is removable or in one piece with said shoe.

The invention and the different applications thereof will be better understood on reading the description that follows and by examining the figures that accompany it.

BRIEF DESCRIPTION OF THE FIGURES

Other characteristics and advantages of the invention will become clear from reading the description that follows, with reference to the following appended figures.

FIG. 2 is a side view of the first exemplary embodiment of a plantar orthosis illustrated in FIG. 1.

FIG. 3 represents a top view of the heel ring and also integrates representations of sections of the heel ring in the longitudinal plane and in the transversal plane of the plantar orthosis.

FIG. 4 represents a top view of the rear pronation corner and also integrates representations of sections in the longitudinal plane and in the transversal plane of the plantar orthosis.

FIG. 5 represents a top view of the internal half-couple, and also integrates representations of sections of the internal half-couple in the longitudinal plane and in the transversal plane of the plantar orthosis.

FIG. 6 represents a top view of the sub-antero-capital element of the first ray, and also integrates representations of sections of the sub-antero-capital element of the first ray in the longitudinal plane and in the transversal plane of the plantar orthosis.

For greater clarity, identical or similar elements are marked by identical reference signs in all of the figures.

DETAILED DESCRIPTION

Figure 1:
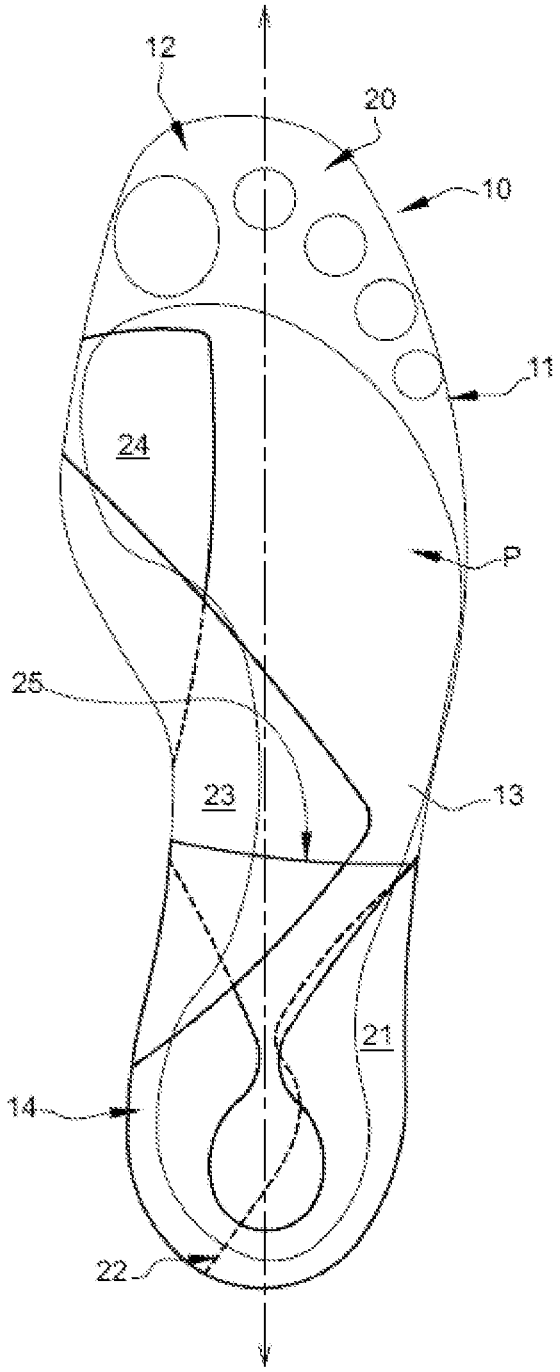
FIG. 1 is a top view of a first exemplary embodiment of a plantar orthosis according to the invention.

In the present application, "longitudinal" is taken to mean the direction in the sense of the length of the foot and of the plantar orthosis and "transversal" the direction in the sense of the width of the foot and of the plantar orthosis.

In the present application, the terms "above", "upper", "below", "lower" are conventionally defined by taking as reference the vertical axis extending along the height of the foot.

The terms "medial limit" or "medial edge" define the internal limit, or the edge, of the plantar orthosis, or of the corrective elements that constitute it.

Conversely, the terms "lateral limit" or "lateral edge" define the external limit, or the edge, of the plantar orthosis, or of the corrective elements that constitute it.

FIG. 1 is a top view of a first exemplary embodiment of a plantar orthosis according to the invention.

FIG. 2 is a side view of the first exemplary embodiment of a plantar orthosis illustrated in FIG. 1.

In this FIG. 1, a footprint of a foot P is represented in order to better visualise the positioning of the foot P of the wearer vis-h-vis the plantar orthosis 10 according to the invention.

The plantar orthosis 10 has a peripheral contour 11 constituting the outer perimeter of the plantar orthosis 10.

The plantar orthosis 10 is constituted of a front part 12 intended to receive the fore foot corresponding to the metatarsals and to the phalanges, a rear part 14 intended to receive the hind foot formed by the rear part of the tarsus, and an intermediate part 13 intended to receive the mid foot formed by the front part of the tarsus.

The plantar orthosis 10 comprises a base 20, cut for example from a thick sheet of a flat material, and which forms a first flat sole of constant thickness. On this base 20 are arranged, in relief, a certain number of corrective elements which will be detailed independently hereafter. The contour of the base 20 defines the overall peripheral contour of the plantar orthosis 10.

In this first exemplary embodiment, the plantar orthosis 10 has:

- a first corrective element constituted by a U-shaped heel ring 21. The heel ring is represented more specifically in FIG. 3;
- a second corrective element constituted by a rear pronation element (EPP) 22, also known by the term rear pronation corner. The pronation corner is represented more specifically in FIG. 4;
- a third corrective element constituted by an internal half-couple 23. The internal half-couple 23 is represented more specifically in FIG. 5;
- a fourth corrective element constituted by a sub-antero-capital support element of the first ray 24 positioned at the level of the first metatarsal. The sub-antero-capital support element of the first ray 24 is represented more specifically in FIG. 6.

It will be noted that the arrangement represented in FIG. 1, representing a first exemplary embodiment of the invention, defines the contour lines of the different corrective elements 21, 22, 23, 24, it being understood that the dimensions of these corrective elements can vary, in their width and in their length. Preferably, the length and/or the width of the corrective elements 21, 22, 23, 24 can vary within the limits of ±10%, and preferably ±7% compared to the dimensions represented in FIG. 1. It will also be noted that the dimensions of the corrective elements 21, 22, 23, 24 are obviously proportional to the sizes of the plantar orthoses.

FIG. 3 represents a top view of the heel ring 21, FIG. 3 also integrating representations of sections of the heel ring in the longitudinal plane and in the transversal plane.

The heel ring 21 is used as neutral stabilisation element of the hind foot, notably improving the distribution of loads and ensuring a better maintaining of the heel of the wearer with respect to the shoe in which the plantar orthosis 10 is positioned.

The heel ring 21 hugs and accentuates the footprint of the heel (i.e. the calcaneum). It follows the anatomical contours of the rear support of the calcaneum on the ground. It has variable relief and thickness which prefigure the support of the heel on the ground and which are represented by the different representations of sections of FIG. 3.

As may be seen in FIG. 1, the collateral limits 21*a* and 21*a*' (i.e. lateral and medial) of the heel ring 21 are defined by the limits which corresponds to the overhang for adapting the plantar orthosis 10 with the shoe. These limits are slightly convex, the maximum overhang being situated at the level of the rear part up to around half of the length of the heel ring 21.

The rear limit 21*b* of the heel ring 21 is limited by the overhang for adapting the plantar orthosis 10 with the shoe.

The antero-external 21*c*, or antero-lateral, limit of the heel ring 21 is defined by the outer (or lateral) edge of the first sole 20 with regard to the external (lateral) Lisfranc joint.

The antero-medial 21*d*, or antero-internal, limit of the heel ring 21 is defined by the medial edge of the first sole 20 with regard to the medial Chopart joint.

The inner limit 21*e* of the heel ring 21 has two first convex parts 21*e*.1 and 21*e*.1' extending respectively from the antero-medial limit 21*d* or from the antero-external limit 21*c* at the level of each arm of the front portion of the heel ring 21 and a second concave part 21 *e*.2 in the rear portion of the heel ring 21 connecting the two arms, the second concave part 21*e*.2 being substantially parallel to the rear limit 21*b* and to the rear contour of the first sole 20.

In referring to FIG. 3, it is possible to see the different reliefs of the heel ring 21 along the longitudinal direction and along the transversal direction of the plantar orthosis 10.

In the longitudinal direction, the relief of the heel ring 21 has a longitudinal profile 21*f* having (from the rear to the front) a first rectilinear portion 21*f*.1 of constant height at the level of the rear portion of the heel ring 21 then a second rectilinear portion 21*f*.2 of which the height decreases progressively from the rear to the front. The first portion 21*f*.1 of constant height advantageously extends from the rear limit 21*b* up to ¼ antero-medial and ¼ antero-lateral of the heel ring 21.

The longitudinal section III realised at the level of the cross-sectional plane III-III shows the relief of the heel ring 21 in the rear part. The height of the rear part is globally decreasing from the rear limit 21*b* to the internal limit 21 *e*.2, according to a concave profile or according to an inclined plane.

The transversal reliefs of the heel ring 21 are represented more specifically by the cross-sections I and II, realised respectively at the level of the cross-sectional planes I-I and II-II.

Transversally, the height is globally decreasing from the collateral limits 21*a*, 21*a*' to the internal limit 21*e* according to a convex, concave or rectilinear profile.

Concerning the cross-section I at the level of the sectional plane I-I, it represents a transversal profile 21*g* at the level of the front portion of the heel ring 21. The transversal profile 21*g* is of convex or rectilinear shape thus forming an inclined plane, of which the height decreases progressively from the collateral limits 21*a*, 21*a*' to the internal limit 21*e*.

Concerning the cross-section II at the level of the sectional plane II-II, it represents a transversal profile 21*h* at the level of the rear portion of the heel ring 21. The transversal profile 21*h* is of concave or rectilinear shape thus forming an inclined plane, of which the height decreases progressively from the collateral limits 21*a*, 21*a*' to the internal limit 21*e*.

It will also be noted that the height of the heel ring 21 is maximum at the level of its peripheral perimeter.

The positioning of the heel ring 21 in relief at the level of the first sole 20 is realised as a function of the other corrective elements of the plantar orthosis 10 and in such a way as to achieve the best juxtaposition possible without causing discomfort for the wearer.

Thus, the heel ring 21 is glued directly on the first sole 20, that is to say on the upper surface of the first sole 20, according to a so-called "conventional" gluing method or according to a reverse gluing method.

The maximum height of the heel ring 21, at the level of its peripheral perimeter, is comprised between 5 mm and 8 mm, the height being able to vary as a function of the presence or not of an optional damping element which will be described hereafter. Advantageously, the maximum height of the heel ring 21 at the level of its rear peripheral perimeter is 6 mm.

The minimum thicknesses of the heel ring 21 at the level of the internal limit 21*e* make it possible to connect this corrective element gently sloping with the first sole 20 and thus minimise discomfort for the wearer.

The heel ring 21 is a stabilising element for the foot and consequently it is made from a so-called firm material, having a hardness comprised between 50 and 70 Shore A, and advantageously made of a material having a hardness of 60 Shore A.

Advantageously, the heel ring 21 is made from a firm material but with a certain elasticity, and with the least possible remanent compaction, the stresses on this element being important while walking and during the 1$^{st}$ contact with the ground.

As an example, the heel ring 21 may be made of ethylene-vinyl acetate (EVA) foam, polyethylene (PE) foam, polyurethane (PU) foam, polyolefin (PO) foam, latex foam or cork.

FIG. 4 represents a top view of the rear pronation corner 22, FIG. 4 also integrating representations of sections in the longitudinal plane and in the transversal plane.

The rear pronation corner 22 is used as element for wedging the hind foot which displaces the front end of the calcaneum externally and which tends to orient its lower face outwards. Thanks to the advantageous use of the rear pronation corner 22 in complement to the heel ring 21, the rear pronation corner 22 makes it possible to wedge the hind foot in a predetermined and controlled position in valgus, which makes it possible to open the internal knee compartment by a translation of the hind foot, and not by a rotation of the hind foot.

The front limit 22*a* of the rear pronation corner 22 has a portion 22*a*.1 that follows the lateral contour of the first sole 20 and a portion 22*a*.2 which extends facing the lateral Lisfranc joint.

The rear limit 22*b* of the rear pronation corner 22 follows the rear contour of the first sole 20 up to the union of the ⅓ internal and the ⅔ internal of the width of the first sole 20.

At the level of its medial limit 22*c*, the rear pronation corner 22 has a curvature alternatively convex in a front portion 22*c*.1 and concave in a rear portion 22*c*.2. The width of the convex part in a front portion 22*c*.1 may extend between the ⅓ lateral of the width of the first sole 20 and up to the half-width of the first sole 20.

The lateral limit 22*d* of the rear pronation corner 22 is convex and limited by the overhang for adapting the plantar orthosis 10 with the shoe, the maximum overhang being situated at the level of half of the calcaneum.

Referring also to FIG. 4, the different reliefs of the rear pronation corner 22 along the longitudinal direction and along the cross-sections IV-IV and V-V may be seen.

In the longitudinal direction, FIG. 4 is a side view of the rear pronation corner 22 which represents the longitudinal profile 22*e* of the rear pronation corner 22 at the level of the lateral edge. This longitudinal profile 22*e* has a first part 22*e*.2 of constant height, that is to say corresponding to a horizontal plane, between the posterolateral portion of the pronation corner 22 and up to ⅓ rear of the first sole 20, then a second part 22*e*.1 of which the height decreases progressively forwards from the pronation corner 22 and thus forming an inclined plane beyond the rear third of the first sole 20.

In FIG. 4 is also represented the longitudinal profile 22*f* at the level of the cross-sectional plane VI-VI. The longitudinal profile 22*f* has a part 22*f*.1 of constant height in the rear part of the rear pronation corner 22 and a part 22*f*.2 of which the height decreases progressively forwards in the front portion of the rear pronation corner 22.

Transversally, the height of the pronation corner 22 is globally decreasing from the lateral limit 22*d* to the medial limit 22*c* (from outside to inside), according to an inclined plane or according to a concave profile.

The section IV realised at the level of the cross-sectional plane IV-IV, represents the transversal profile 22*g* at the level of the rear portion of the rear pronation corner 22. The transversal profile 22*g* is of slightly concave, or rectilinear, shape thus forming an inclined plane of which the height decreases progressively from the lateral edge to the medial edge. The choice of the profile (rectilinear or concave) at the level of the rear portion is determined as a function of the degree of correction necessary to provide as a function of the pathology of the wearer. Preferentially, the transversal profile 22*g* has a concave shape with a height decreasing progressively from outside (lateral edge) to inside (medial edge).

The section V realised at the level of the cross-sectional plane V-V, represents the transversal profile 22*h* of the rear pronation corner 22 at the level of the front portion of the rear pronation corner 22. The transversal profile 22*h* has a rectilinear shape of plane inclined in the height and decreases progressively from the lateral edge to the medial edge.

The positioning of the rear pronation corner 22 at the level of the first sole 20 is made as a function of the other corrective elements of the plantar orthosis and as a function of the footprint of the wearer in such a way as to achieve the best possible juxtaposition without causing discomfort for the wearer.

Thus, according to a first positioning mode, the rear pronation corner 22 is glued on the first sole 20, that is to say on the upper surface of the first sole 20, according to a so-called "conventional" gluing method or according to a reverse gluing method. In this first mode of positioning the rear pronation corner 22, it is positioned between the heel ring 21 described previously and the first sole 20.

According to a second positioning mode represented in FIG. 1 and in FIG. 2, the rear pronation corner 22 is glued under the first sole 20, that is to say on the lower surface of the first sole 20, according to a reverse gluing method.

The rear pronation corner 22 has a maximum height at the level of its lateral limit 22*d*. The choice of the maximum height at the level of the lateral limit 22*d* is made as a function of the importance of the shrinkage of the internal femorotibial compartment of the wearer and the pain felt. Generally, the maximum height of the rear pronation corner 22 is comprised between 3 mm and 7 mm. According to a preferential embodiment, the rear pronation corner 22 has a maximum height of 6 mm.

The minimum thicknesses of the rear pronation corner 22 at the level of the medial edge and at the level of the front edge make it possible to connect it gently sloping with the first sole 20 and/or the heel ring (as a function of the positioning mode) to minimise discomfort for the wearer.

The rear pronation corner 22 is made from a firm material but with a certain elasticity, and with the least remanent compaction possible. Indeed, stresses on the rea pronation corner 22 are important while walking and during the 1$^{st}$ contact with the ground. The rear pronation corner 22 being an important element which leads to translation enabling the transfer of load, it must not have too important remanent deformation.

As an example, the rear pronation corner 22 is made of ethylene-vinyl acetate (EVA) foam, polyethylene (PE) foam, polyurethane (PU) foam, polyolefin (PO) foam, latex foam, or cork.

The rear pronation corner 22 is made of a material having a hardness comprised between 50 Shore A and 70 Shore A. According to an exemplary embodiment, the rear pronation corner 22 has a hardness of 60 Shore A.

FIG. 5 represents a top view of the internal half-couple 23, FIG. 5 also integratingrepresentationsofsectionsoftheinternalhalf-coupleinthelongitudinalplane and in the transversal plane.

The internal half-couple 23 is used as internal corrective element to wedge the mid foot during sagging of the inner arch of the foot and for filling the void of the inner arch of the foot while thus increasing its bearing surface. The half-couple 23 is used as anti-valgus corrector on the mid foot.

The shape, the relief and the materials of the internal half-couple 23 are advantageously chosen such that this internal corrective element stabilises the mid foot as it sags but without creating a hypercorrection risking deviating the position of the foot from valgus to *varus*.

The front limit 23*a* of the internal half-couple 23 is represented by the point being located on the medial contour of the first sole 20 at the level of the neck of the 1$^{st}$ metatarsal.

The rear limit 23*b* of the internal half-couple 23 is represented by the point being located on the medial contour of the first sole 20 at the level of half of the length of the calcaneum.

The medial limit 23*c* of the internal half-couple 23 is limited by the overhang for adapting with the shoe. This medial limit 23*c* may have a straight shape or instead a curvature with a concave profile closer to the shape of the medial edge of the first sole 20.

The lateral limit 23*d* of the half-couple 23 has a maximum width situated directly in line with the navicular between the lateral Chopart joint and the naviculocuneiform joint. The maximum width of the lateral limit 23*d* is preferentially situated between half the width of the first sole 20 and the lateral edge of the first sole 20.

Referring also to FIG. 5, it is also possible to see the different reliefs of the internal half-couple 23 along the longitudinal direction and along the transversal direction.

The section VII realised at the level of the cross-sectional plane VII-VII, represents the longitudinal profile 23*e* of the half-couple of convex shape of which the maximum height of the bulge is situated directly in line with the navicular.

Transversally, the height of the half-couple 23 is globally decreasing from the medial limit 23*c* to the lateral limit 23*d* (from inside to outside), according to a concave profile. The transversal profile 23*f* is represented more specifically by the cross-section VIII realised at the level of the cross-sectional plane VIII-VIII.

The positioning of the internal half-couple 23 at the level of the first sole 20 is realised as a function of the other corrective elements of the plantar orthosis and as a function of the footprint of the wearer in such away as to achieve the best possible juxtaposition without causing discomfort for the wearer.

The internal half-couple 23 is advantageously positioned in superposition on the first sole 20 (i.e. on the upper surface of the first sole 20) and covers the front part of the heel ring 21. The gluing of the internal half-couple 23 is carried out according to a so-called "conventional" gluing method or according to a reverse gluing method.

The choice of the dimensioning of the internal half-couple 23 and its maximum height is made as a function of the importance of the sagging of the mid foot of the wearer ad the morphology of the foot, and more specifically of the plantar *cavus*, that is to say the sub-navicular deflection which is evaluated during clinical examination under unipodal load. The maximum height of the internal half-couple 23 is advantageously greater than this deflection. Advantageously, the internal half-couple 23 has a maximum height of 20 mm.

The minimum thicknesses at the level of the front limit 23*a*, the lateral limit 23*d* and the rear limit 23*b* of the internal half-couple 23 make it possible to connect the corrective element gently sloping with the first sole 20 and the other corrective elements in order to minimise discomfort for the wearer.

The internal half-couple 23 has the function of hugging the arch of the foot, consequently, the material used must have properties of moulding with the weight and the heat of the foot. Thus, the material used for the internal half-couple 23 is preferentially a thermoformable material, for example an ethylene-vinyl acetate (EVA) foam, a polyethylene (PE) foam, a polyurethane (PU) foam, a polyolefin (PO) foam, a latex foam, or cork.

The internal half-couple 23 is made of a material having a hardness comprised between 20 Shore A and 40 Shore A. According to an exemplary embodiment, the material of the internal half-couple 23 is a material having a hardness of 25 Shore A.

FIG. 6 represents a top view of the sub-antero-capital support element of the first ray 24, FIG. 6 also integrating representations of sections of the sub-antero-capital support element of the first ray in the longitudinal plane and in the transversal plane.

The fourth corrective element is a sub-antero-capital support element of the first ray 24 positioned at the level of the first metatarsal. The sub-antero-capital support element of the first ray 24 is positioned in superposition between the first sole 20 and the half-couple 23 described previously.

The sub-antero-capital support element 24 is used to re-establish the stability of the forefoot while preventing dynamic hyper-pronation thereof, in other words the sub-antero-capital support element of the first ray 24 has an anti-valgus role.

The front limit 24*a* is situated at the level of the line L1 materialising the sub-digital space of the first ray, between ⅔ of the mid foot and the medial edge of the first sole 20.

The rear limit 24*b* is represented as an example at the level of the transmetatarsal line L2, but does not have particular therapeutic interest and may be situated slightly in front of or slightly behind this line L2. In FIG. 6, the rear limit 24*b* is represented by the point situated at the intersection of the medial contour of the first sole 20 and the transmetatarsal line L2.

The medial limit 24*c* of the sub-antero-capital element of the first ray follows the contour of the first sole 20.

The lateral limit 24*d* of the sub-antero-capital element of the first ray has a first rectilinear portion 24*d*.1 that extends from the first intermetatarsal space up to the first metatarsal and a curved second portion 24*d*.2, of slightly convex shape, which extends from the first metatarsal up to the rear limit 24*b*.

Referring also to FIG. 6, the different reliefs of the sub-antero-capital support element of the first ray 24 along the longitudinal direction and along the transversal direction of the plantar orthosis 10 may be seen.

In the longitudinal direction, the longitudinal profile 24*f* is represented at the level of the cross-sectional plane IX-IX. The longitudinal profile 24*f* has a first part 24*f*.1 of constant height, thus forming a plateau of constant thickness, and a second part 24*f*2 of height decreasing along an inclined plane with a height decreasing in the direction of the rear limit 24*b*. The first part 24*f*.1 of constant height extends between the front limit 24*a* and the neck of the first metatarsal. The second part 24*f*.2 extends between the neck of the first metatarsal and the rear limit 24*b*.

Transversally, the thickness of the sub-antero-capital support element of the first ray 24 is constant between the medial limit 24*c* and the lateral limit 24*d*. The transversal profile 24*g* is represented at the level of a first cross-sectional plane X-X in the front part of the element 24 and at the level of a second cross-sectional plane XI-XI in the rear part of the element 24.

The positioning of the sub-antero-capital support element of the first ray 24 at the level of the first sole 20 is made as a function of the other corrective elements of the plantar orthosis and as a function of the footprint of the wearer in such a way as to achieve the best possible juxtaposition without causing discomfort for the wearer.

The sub-antero-capital support element of the first ray 24 is advantageously positioned in superposition on the first sole 20 (i.e. on the upper surface of the first sole 20), and more specifically between the internal half-couple 23 and the first sole 20, such that the internal half-couple 23 partially covers the rear part of the sub-antero-capita support element of the first ray 24. The gluing of the sub-antero-capital support element of the first ray 24 is carried out according to a so-called "conventional" gluing method or according to a reverse gluing method.

The sub-antero-capital support element of the first ray has a maximum thickness comprised between 1 mm and 3 mm.

The minimum thicknesses of the sub-antero-capital support element of the first ray 24 at the level of the rear part of the element 24 make it possible to connect it gently sloping with the first sole 20 and notably with the internal half-couple 23 superimposing the sub-antero-capital support element of the first ray 24, notably to minimise discomfort for the wearer.

The sub-antero-capital support element of the first ray 24 is made from a firm material having a hardness comprised between 50 Shore A and 70 Shore A.

As an example, the sub-antero-capital support element of the first ray 24 is made of ethylene-vinyl acetate (EVA) foam, polyethylene (PE) foam, polyurethane (PU) foam, polyolefin (PO) foam, latex foam, or cork.

According to a second exemplary embodiment (not represented) of a plantar orthosis according to the invention, the plantar orthosis comprises:

- a first corrective element constituted by a U-shaped heel ring 21, such as described previously in the first exemplary embodiment;
- a second corrective element constituted by a rear pronation element (EPP) 22, also known by the term rear pronation corner, such as described previously in the first exemplary embodiment; and
- a third corrective element constituted by an internal half-couple 23, such as described previously in the first exemplary embodiment.

In this second exemplary embodiment of a plantar orthosis, less optimum than the first exemplary embodiment described previously, the sub-antero-capital support element is not used, making the plantar orthosis simpler to produce and more economical for the wearer. The plantar orthosis of this second exemplary embodiment makes it possible to provide sufficient anatomical correction which may be sufficient in certain cases to eliminate the symptoms.

According to a third exemplary embodiment (not represented) of a plantar orthosis according to the invention, the plantar orthosis is identical to the plantar orthosis 10 of the first exemplary embodiment, or to the plantar orthosis 110 of the second exemplary embodiment, and further comprises a flexible damping element 25 having the shape of a heel pad and positioned at the level of the rear part 14 of the plantar orthosis 210.

The damping element 25 is positioned above the heel ring 21 such that the damping element 25 covers at least partially the heel ring 21.

The damping element 25 has an overall thickness in correlation with the thickness of the heel ring 21. Thus, as an example, it is advantageous to use a damping element 25 of 3 mm with a heel ring 21 having a maximum height of 6 mm. According to another example, it is advantageous to use a damping element 25 of 5 mm with a heel ring 21 having a maximum height of 8 mm.

Advantageously, the damping element 25 is made of a damping material, such as for example a viscoelastic foam. For example, it is possible to make the damping element 25 to use a material from among the following list: an elastic EVA foam, a viscoelastic urethane (sorbothane) foam, a neoprene @foam.

In this third embodiment comprising a damping element 25, the heel ring 21 advantageously has a height more important than for a use without a damping element 25. Advantageously, the maximum height of the heel ring 21 at the level of its peripheral perimeter is 8 mm.

Table 1 below shows an example of correlation between the hardness of the material used and the maximum height of the corrective elements 21, 22, 23, 24 of the plantar orthosis 10.

TABLE 1

| 5 lines by 4 columns | | | |
|---|---|---|---|
| | Height/Hardness | | |
| Heel ring | 5 mm in 70 Shore A | 6 mm in 60 Shore A | 8 mm in 50 Shore A |
| Rear pronation corner | 3 mm in 70 Shore | 6 mm in 60 Shore A | 7 mm in 50 Shore A |
| Internal half-couple | 20 mm bulge in 20 Shore A | 15 mm bulge in 25/30 Shore A | 10 mm bulge in 40 Shore A |
| Sub-antero-capital support element of the first | 1 mm in 70 Shore A | 2 mm in 60 Shore A | 3 mm in 50 Shore A |

The subject matter of the invention is also a method for manufacturing a plantar orthosis described previously.

The plantar orthosis according to the invention may be manufactured by different techniques known from the prior art, namely the conventional techniques that will be described hereafter, thermoforming, manufacturing by 3D printing or 3D scanner.

The manufacturing method comprises a first step of cutting a base 20, or first sole, from a thick sheet of a flat material. The cutting is carried out to measure from the plantar footprint P obtained by a footprinting method. The plantar footprint may be taken for example by a podograph, a footprint impression cushion, a scanner, a 3D scanner, a baropodometric platform, by taking a footprint by moulding with plaster or instead by any other means known from the prior art.

The plantar footprint obtained makes it possible to obtain different corrective elements of the plantar orthosis 10 according to the aforementioned anatomical reference points.

The manufacturing method comprises a second step of gluing the rear pronation corner 22 on the first sole 20. This corrective element is advantageously glued first on the first sole 20. As indicated previously, the rear pronation corner 22 may be positioned in relief on the upper surface of the first sole 20, or instead on the lower surface of the first sole 20, as illustrated in FIGS. 1 and 2.

The manufacturing method comprises a third step of gluing the heel ring 21. The heel ring is positioned in relief directly on the first sole 20, or in part on the rear pronation corner 22 and the first sole 20, as a function of the mode of positioning the rear pronation corner 22 on the first sole 20 made during the preceding step.

The manufacturing method comprises a fourth step of gluing the half-couple 23. The half-couple is positioned in relief on the first sole 20 and on the corrective elements already in position.

When the plantar orthosis 10 comprises a sub-antero-capital support element of the first ray 24, optional, the manufacturing method comprises an intermediate step consisting in gluing the sub-antero-capital support element of the first ray 24, this intermediate step being carried out between the step of gluing the heel ring 21 and the step of gluing the half-couple 23.

According to an alternative embodiment, the step of gluing the sub-antero-capital support element of the first ray 24 may be carried out before the step of gluing the heel ring 21. The two elements not having any surface in superposition, the order of gluing of one or the other element thus does not have any importance for the production of the plantar orthosis according to the invention.

The plantar orthosis 10 according to the invention is a sole which may be transferred into a shoe, or quite the opposite be made of one piece with the cleanliness sole of the shoe, or instead the first sole for assembling the shoe, or instead the outer sole of the shoe, the plantar orthosis 10 being able to be removable or not with respect to the shoe.

The plantar orthosis 10 according to the invention advantageously makes it possible to provide a decompression apparatus making it possible to treat the symptoms and pain linked to the following pathologies:

internal femorotibial osteoarthritis;

tear of the internal meniscus of the knee, iliotibial band syndrome.

The subject matter of the invention is also a shoe comprising a plantar orthosis 10 according to the invention.

The invention claimed is:

1. A plantar orthosis comprising a first sole and a plurality of raised corrective elements, said first sole extending along a longitudinal axis from a rear distal end to a front distal end, said plurality of raised corrective elements consisting of:

a first corrective element formed by a heel ring;

a second corrective element formed by a rear pronation element having a height globally decreasing from a lateral limit to a medial limit;

a third corrective element formed by an internal half-couple, and a fourth corrective element formed by a sub-antero-capital support element of the first ray positioned at a level of the first metatarsal, said fourth corrective element being confined on one side of the longitudinal axis, wherein said third corrective element formed by an internal half-couple is positioned above said first corrective element such that said third corrective element covers at least partially said first corrective element.

2. The plantar orthosis according to claim 1, wherein said first corrective element and/or said second corrective element and/or said third corrective element and/or said fourth corrective element is formed from a material from the following list: ethylene-vinyl acetate (EVA) foam, polyethylene (PE) foam, polyurethane (PU) foam, polyolefin (PO) foam, latex foam, cork.

3. The plantar orthosis according to claim 1, wherein said first corrective element comprises a maximum height comprised between 5 mm and 8 mm.

4. The plantar orthosis according to claim 3, wherein the height of said first corrective element is 6 mm.

5. The plantar orthosis according to claim 1, wherein said second corrective element comprises a maximum height comprised between 3 mm and 7 mm.

6. The plantar orthosis according to claim 5, wherein the height of said second corrective element is 6 mm.

7. The plantar orthosis according to claim 1, wherein said third corrective element comprises a maximum height of 20 mm.

8. The plantar orthosis according to claim 1, wherein said fourth corrective element comprises a maximum height comprised between 1 mm and 3 mm.

9. The plantar orthosis according to claim 1, wherein said first corrective element, and/or said second corrective element, and/or the fourth corrective element has a hardness comprised between 50 Shore A and 70 Shore A.

10. The plantar orthosis according to claim 1, wherein said third corrective element has a hardness comprised between 20 Shore A and 40 Shore A.

11. The plantar orthosis according to claim 1, wherein said plantar orthosis comprises a damping element positioned above said first corrective element.

12. The plantar orthosis according to claim 1, wherein said second corrective element formed by a rear pronation element is positioned on said first sole or under the first sole.

13. A shoe comprising a plantar orthosis according to claim 1.

14. The plantar orthosis according to claim 1, wherein said second corrective element has a hardness comprised between 50 Shore A and 70 Shore A.

* * * * *